US010215103B2

(12) United States Patent
Barr

(10) Patent No.: US 10,215,103 B2
(45) Date of Patent: Feb. 26, 2019

(54) THROTTLE VALVE ASSEMBLY

(71) Applicant: Ford Global Technologies, LLC, Dearborn, MI (US)

(72) Inventor: William Gerald Barr, Chelmsford (GB)

(73) Assignee: Ford Global Technologies, LLC, Dearborn, MI (US)

( * ) Notice: Subject to any disclaimer, the term of this patent is extended or adjusted under 35 U.S.C. 154(b) by 2 days.

(21) Appl. No.: 15/695,121

(22) Filed: Sep. 5, 2017

(65) Prior Publication Data

US 2018/0073443 A1 Mar. 15, 2018

(30) Foreign Application Priority Data

Sep. 15, 2016 (GB) ..... 1615728.1

(51) Int. Cl.
*F02D 9/10* (2006.01)
*F02D 11/10* (2006.01)

(52) U.S. Cl.
CPC ..... *F02D 9/101* (2013.01); *F02D 9/103* (2013.01); *F02D 9/109* (2013.01); *F02D 9/1065* (2013.01); *F02D 11/106* (2013.01); *F02D 11/105* (2013.01); *F02D 2011/102* (2013.01)

(58) Field of Classification Search
CPC ..... F02D 9/101; F02D 9/1005; F02D 9/10; F02D 9/1015; F02D 9/1025; F02D 9/103; F02D 9/1065; F02D 9/109; F02D 9/1095; F02D 9/16
See application file for complete search history.

(56) References Cited

U.S. PATENT DOCUMENTS 4,064,843 A * 12/1977 Holzbaur ..... F02M 69/043 123/455
4,633,833 A * 1/1987 Morris ..... F02D 9/1045 123/336
2002/0005185 A1* 1/2002 Schatz ..... F02B 29/083 123/403

FOREIGN PATENT DOCUMENTS

| | | | |
|---|---|---|---|
| EP | 1378714 | A1 | 1/2004 |
| GB | 191406694 | A | 9/1914 |
| GB | 164168 | A | 6/1921 |
| GB | 836810 | A | 6/1960 |
| GB | 1058431 | A | 2/1967 |
| GB | 1064373 | A | 4/1967 |

OTHER PUBLICATIONS

Intellectual Property Office of the United Kingdom, Combined Search and Examination Report Issued in Application No. GB1615728.1, dated Feb. 15, 2017, 5 pages.

* cited by examiner

*Primary Examiner* — Jacob Amick
(74) *Attorney, Agent, or Firm* — Julia Voutyras; McCoy Russell LLP

(57) ABSTRACT

A throttle valve assembly is disclosed having a throttle valve mounted within a throttle body to vary the flow of air therethrough. The throttle valve comprises of first and second throttle plates that interact with one another so as to be configurable in a V-shape thereby forming a converging/diverging flow path through part of the throttle body in which the flow of air through the throttle body is restricted and in flat aligned configuration which is minimally intrusive so as to produce substantially no restriction to flow through the throttle body is produced by the throttle valve.

19 Claims, 5 Drawing Sheets

THROTTLE VALVE ASSEMBLY

CROSS REFERENCE TO RELATED APPLICATION

The present application claims priority to Great Britain Patent Application No. 1615728.1, filed Sep. 15, 2016. The entire contents of the above-referenced application are hereby incorporated by reference in its entirety for all purposes.

FIELD

This disclosure relates to the control of air flow into an internal combustion engine and in particular to a throttle valve assembly for controlling air flow into an internal combustion engine.

BACKGROUND/SUMMARY

It is known to use a butterfly type valve to control the flow of air into an internal combustion engine. It will be appreciated that the term 'air' as meant herein includes not only atmospheric air admitted via an air inlet but also other gas flows to the engine such as, for example, recirculated exhaust gas and crankcase ventilation gas.

It is a problem with such a butterfly arrangement that when the butterfly valve is in a partially open position considerable downstream turbulence is produced which has an adverse effect on engine efficiency. Even at wide open throttle there will be a pressure drop and turbulence from the throttle plate of a butterfly type valve.

It is an object of this invention to provide a more efficient type of throttle valve.

According to a first aspect of the invention there is provided a throttle valve assembly comprising a throttle body defining a quadrilateral shaped air flow passage and a throttle valve mounted in the air flow passage of the throttle body wherein the throttle valve comprises first and second interacting throttle plates configurable to produce a convergent/divergent flow restricting configuration when a reduced flow of air through the throttle body is required and into a flat minimally intrusive flow restricting configuration when no reduction in the flow of air through the throttle body is required wherein the first throttle plate is positioned upstream from the second throttle plate and forms the convergent part of the convergent/divergent flow restricting configuration and the second throttle plate forms the divergent part of the convergent/divergent flow restricting configuration.

The assembly may further comprise an actuator and the first and second throttle plates are configurable by the actuator to produce the convergent/divergent flow restricting configuration when a reduced flow of air through the throttle body is required and into the flat minimally intrusive flow restricting configuration when no reduction in the flow of air through the throttle body is required.

The first throttle plate may be rotatable about one end by the actuator and the second throttle plate may be rotatable by the interaction of the second throttle plate with the first throttle plate.

The quadrilateral air flow passage may be defined by an upper wall of the throttle body, a lower wall of the throttle body and two side walls of the throttle body and the first throttle plate may be pivotally connected to the upper wall of the throttle body.

The second throttle plate may be rotatably connected to the upper wall of the throttle body and may interact with the first throttle plate via a sliding interaction of a free end of the second throttle plate with a rear face of the first throttle plate.

In the flat minimally intrusive flow restricting configuration the first and second throttle plates may lie upon one another against an inner surface of the upper wall of the throttle body. Alternatively, the second throttle plate may interact with the first throttle plate via a pivotal connection and may have a free end slidingly abutting an inner surface of the upper wall of the throttle body.

In which case, in the flat minimally intrusive flow restricting configuration, the first and second throttle plates may lie end to end against the inner surface of the upper wall of the throttle body.

According to a second aspect of the invention there is provided an engine air induction control system for a motor vehicle comprising an air flow path to an engine including a throttle valve assembly constructed in accordance with said first aspect of the invention, an electronic controller, an accelerator pedal position sensor associated with an accelerator pedal of the motor vehicle to provide a driver torque demand input to the electronic controller and an electronically controllable actuator forming part of the throttle valve assembly operably connected to the electronic controller.

The electronic controller may be arranged to operate the electronically controllable actuator to move the throttle valve based upon the driver demand input from the accelerator pedal position sensor.

The electronic controller may be operable to use the electronically controllable actuator to move the throttle valve of the throttle valve assembly to increase the air flow area of the throttle body from the current air flow area if the input from the accelerator pedal position sensor indicates a request for increased engine torque.

The electronic controller may be operable to use the electronically controllable actuator to move the throttle valve of the throttle valve assembly to reduce the air flow area of the throttle body from the current air flow area if the input from the accelerator pedal position sensor indicates a request for reduced engine torque.

According to a third aspect of the invention there is provided a motor vehicle having an internal combustion engine and an engine air induction control system constructed in accordance with said second aspect of the invention.

BRIEF DESCRIPTION OF THE DRAWING

With reference to FIG. 1 there is shown a motor vehicle 5 having a direct injection gasoline engine 10.

DETAILED DESCRIPTION

Figure 1:
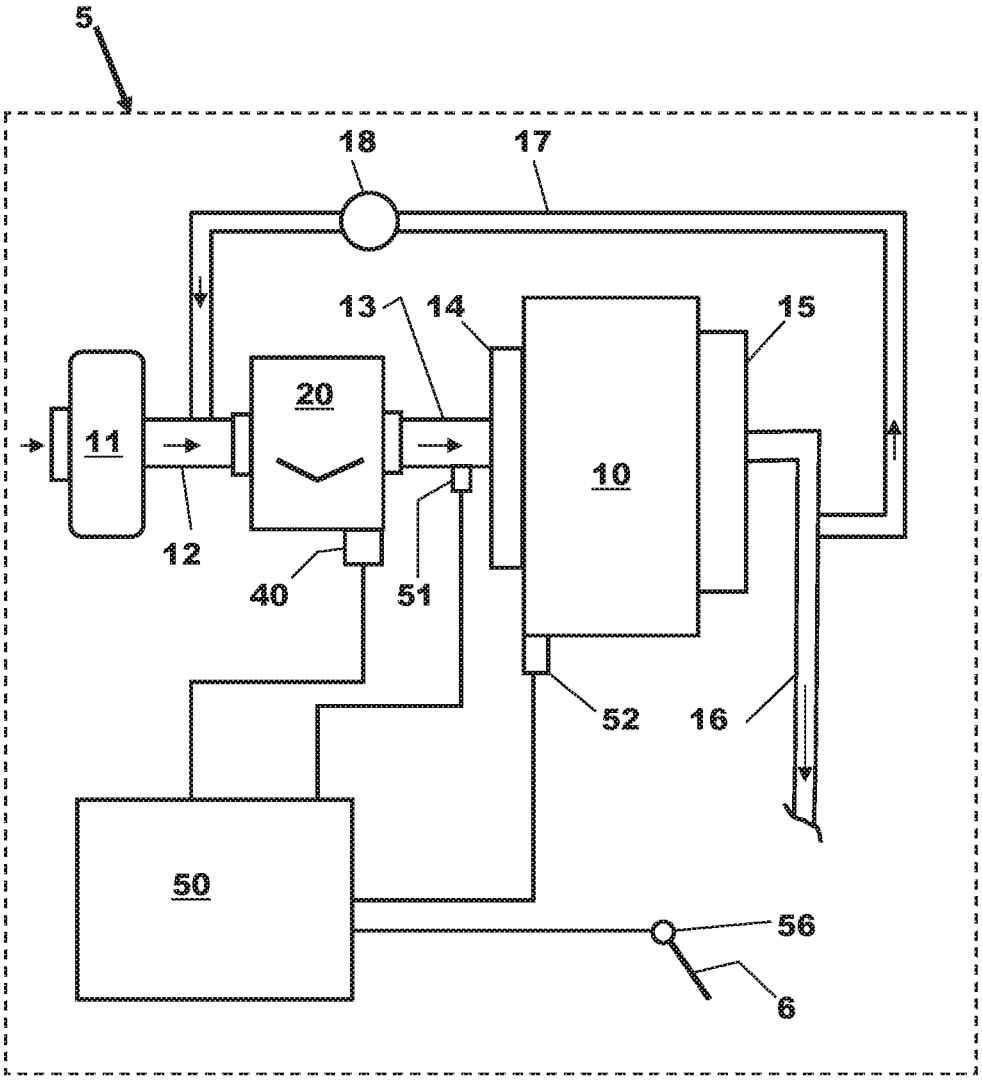
FIG. 1 is a schematic diagram showing a motor vehicle according to a third aspect of the invention having an engine air induction control system in accordance with a second aspect of the invention that includes a throttle valve assembly constructed in accordance with a first aspect of the invention.

Air is supplied to the engine 10 via an air inlet manifold 14 and exhaust gasses flow out from the engine to atmosphere via an exhaust manifold 15 and an exhaust pipe 16. It will be appreciated that one or more emission control devices (not shown) will normally be included in the flow path of the exhaust gas from the engine 10 to atmosphere.

Atmospheric air enters a first induction duct 12 via an air filter 11 and flows through an air flow passage forming part of a throttle valve assembly 20 to a second induction duct 13 which is connected to the inlet manifold 14 of the engine 10.

An exhaust gas recirculation system comprises an exhaust gas recirculation pipe 17 connect at one end to the exhaust pipe 16 and connected at an opposite end to the first induction duct 12. An exhaust gas recirculation valve 18 is used as is well known in the art to control the flow of exhaust gas through the exhaust gas recirculation pipe 17. It will be appreciated that in practice the exhaust gas may flow through an intercooler before flowing back to the first induction duct 12 and that the invention is not limited to a normally aspirated engine having exhaust gas recirculation of the type shown.

The throttle valve assembly 20 forms part of an engine air induction control system that also includes an electronic controller 50 and a number of sensors of which only a mass air flow sensor 51, an engine speed sensor 52 and an accelerator pedal position sensor 56 associated with an accelerator pedal 6 are shown in FIG. 1.

The electronic controller 50 is shown in FIG. 1 as a conventional microcomputer including non-transitory memory or read only memory for storing executable instructions, the instructions for performing the methods described herein. The electronic controller 50 is shown receiving various signals from sensors coupled to the engine 10, and transmitting instructions to various actuators. The sensors may include the accelerator position sensor 56, engine speed sensor 52 and mass air flow sensor 51, for example. The actuators may include actuator 40 or actuator 140, for example.

It will be appreciated that in practice the electronic controller 50 will normally also control the flow of fuel to the engine 10 and that the fuel supply system has been omitted from FIG. 1 as it is not directly relevant to this invention.

Although not shown in FIG. 1, the electronic controller 50 is also connected to the exhaust gas control valve 18 to control the flow of exhaust gas flowing through the exhaust gas recirculation pipe 17.

The throttle valve assembly 20 includes an electronically controllable actuator that is controlled by the electronic controller 50. It will be appreciated that the electronic controller 50 may in practice not directly control the actuator 40 but rather control one or more other devices that are used to control the actuator 40.

Figure 2A:
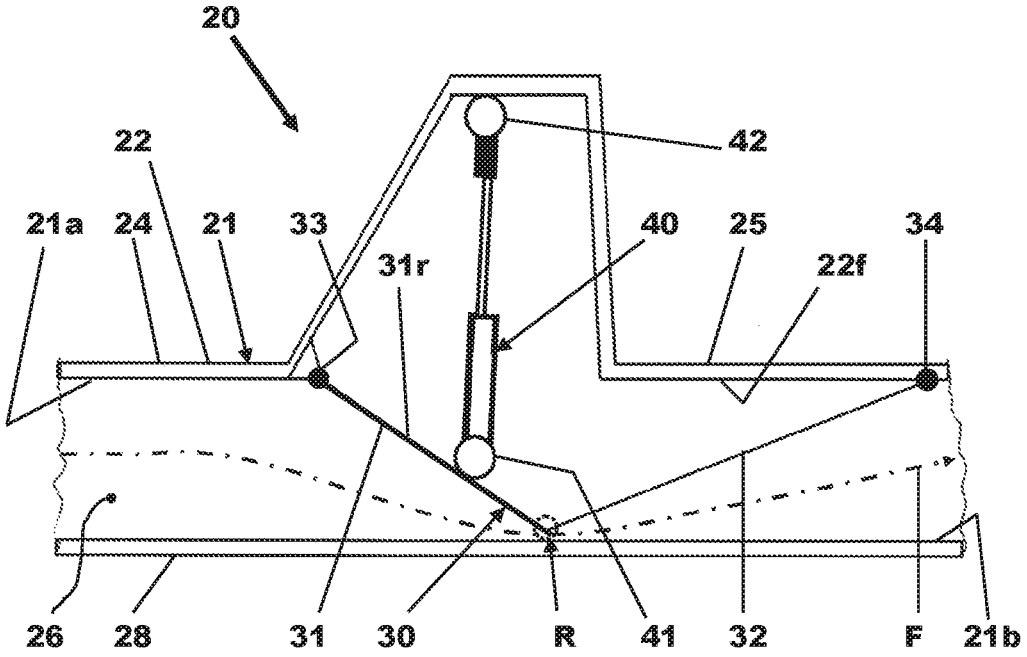
FIG. 2A is a diagrammatic cut-away side view of a throttle valve assembly constructed in accordance with said first aspect of the invention showing a first embodiment of a throttle valve in a throttle closed position.
Figure 2B:
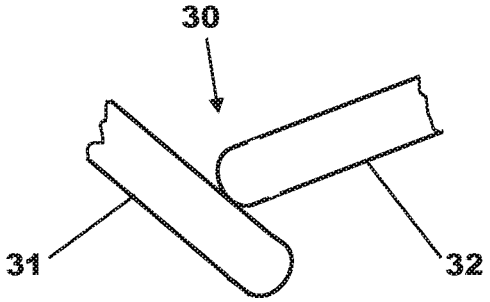
FIG. 2B is an enlarged view in the region R on FIG. 2A showing the shaped ends of first and second throttle plates forming the throttle valve.
Figure 3:
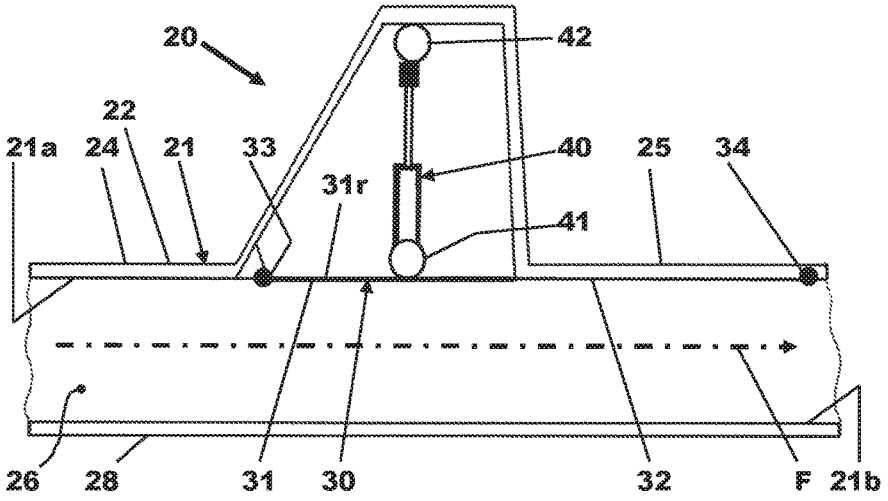
FIG. 3 is a diagrammatic cut-away side view similar to FIG. 2A but showing the throttle valve in a wide open throttle position.

With particular reference to FIGS. 2A-3, the throttle valve assembly 20 comprises a throttle body 21 in which is mounted a throttle valve 30 the position of which is adjustable by the actuator 40. The actuator 40 in this case comprises an electromagnetic linear actuator in the form of a ram having a ram body pivotally attached at one end via a pivotal connection 41 to a first throttle plate 31 of the throttle valve 30 and a ram rod pivotally connected via a pivotal connection 42 to the throttle body 21. The ram along with the pivotal connections 41, 42 form an electronically controllable actuator mechanism. It will be appreciated that the ram could be connected to the first throttle plate 31 by a sliding connection instead of a pivotal connection but in such a case a spring will need to be provided to bias the first throttle plate 31 against the ram.

The throttle body 21 comprises an upper wall 22 having an inlet portion 24 upstream from the throttle valve 30 and an outlet portion 25 downstream from the throttle valve 30, a lower wall 28 and two side walls 26 of which only one is shown.

A quadrilateral shaped inlet air flow passage is formed by the throttle body 21 having an inlet 21*a* formed by the inlet portion 24 of the upper wall 22, the lower wall 28 and the two side walls 26. In the case of this example the air flow passage including the inlet 21*a* is rectangular in shape and has a width that is greater than its height. It will be appreciated that in alternative embodiments the height could be greater than the width or the width and height could be substantially the same if the air flow passage is square in shape.

A quadrilateral shaped outlet 21*b* of the air flow passage is formed at an outlet end of the throttle body 21 by the outlet portion 25 of the upper wall 22, the lower wall 28 and the two side walls 26. In the case of this example the outlet 21*b* is rectangular in shape having a width that is greater than its height. It will be appreciated that the width and height dimensions of the outlet 21*b* are substantially the same as the corresponding dimensions of the inlet 21*a*. As before other quadrilateral shapes could be used for the air flow passage.

The throttle valve 30 comprises a pair of interacting throttle plates 31, 32 therebeing the first or upstream throttle plate 31 pivotally connected at an upper end to the throttle body 21 by a hinge 33 and pivotally connected to the actuator 40 by the pivotal connection 41 and a second or downstream throttle plate 32 pivotally connected at an upper end to the throttle body 21 by a hinge 34.

The second throttle plate 32 rests against a rear face 31*r* of the first throttle plate 31 and interacts with the first throttle plate 31 by sliding up the rear face 31*r* of the first throttle plate 31 when the throttle valve 30 is moved in an opening direction and by sliding down the rear face 31*r* of the first throttle plate 31 when the throttle valve 30 is moved in a closing direction. As shown in FIG. 2B the ends of the first and second throttle plates 31 and 32 are shaped to aid sliding of the second throttle plate 32 on the first throttle plate 31 and to reduce turbulence particularly when the throttle valve 30 is not in the wide open throttle position.

When the throttle valve 30 is in a flow restricting position the first throttle plate 31 forms with respect to the direction of air flow (indicated on FIGS. 2A-3 by the chain dotted arrow F) a converging flow passage and the second throttle plate forms a diverging flow passage. The first and second throttle plates 31 and 32 are arranged in a "V" or convergent/divergent flow restricting configuration defining an internal angle therebetween which in the case of this example varies from substantially 180 degrees to substantially 125 degrees.

In the case of this example a free end of the first throttle plate 31 is spaced a small distance from the lower wall 28 of the throttle body when the throttle valve 30 is in the fully closed position but it will be appreciated that in other embodiments the free end of the first throttle plate 31 could about the lower wall 28 of the throttle body 21.

When the throttle valve 30 is in the wide open throttle position shown in FIG. 3, the first and second throttle plates 31 and 32 lie upon one another against an inner surface 22*f* of the upper wall 22 of the throttle body 21 thereby bridging between the inlet and outlet portions 24 and 25 of the upper wall 22 and forming a substantially flat continuous surface so as to produce minimum resistance to air flow. In this position the first and second throttle plates 31 and 32 are said to be in a flat minimally intrusive configuration and the internal angle between the first and second throttle plates 31 and 32 is substantially equal to 180 degrees.

It will be appreciated that as the throttle valve 30 is transitioned from the wide open position shown in FIG. 3 to the fully closed position shown in FIG. 2A the flow area of the air flow passage in the throttle body 21 is reduced from a maximum air flow area to a minimum air flow area and as the throttle valve 30 is transitioned from the fully closed position shown in FIG. 2A to the wide open position shown in FIG. 3 the flow area of the air flow passage in the throttle body 21 is increased from a minimum air flow area to a maximum air flow area.

It will be appreciated that a spring (not shown) could be used to maintain the second throttle plate 32 in contact with the rear face 31*r* of the first throttle valve 31 at all times.

Operation of the throttle valve assembly 20 is as follows. From the fully closed throttle position shown in FIG. 2A, to increase the air flow area of the throttle body 21 and hence the flow rate of air through the throttle body 21 the first throttle plate 31 of the throttle valve 30 is rotated by the actuator 40 in a anticlockwise direction as viewed about the hinge 33 until it reaches a wide open throttle position as shown in FIG. 3. The movement of the first throttle plate 31 causes the second throttle plate 32 to be rotated in a clockwise direction as viewed about the hinge 34 due to the sliding interaction between the second throttle plate 32 and the rear face 31*r* of the first throttle plate 31. This has the effect of increasing the internal angle between the first and second throttle plates 31 and 32 until when the wide open throttle position is reached the internal angle is substantially equal to 180 degrees.

From the wide open throttle position shown in FIG. 3, to reduce the air flow area of the throttle body 21 and hence the flow rate of air through the throttle body 21 the first throttle plate 31 of the throttle valve 30 is rotated by the actuator 40 in a clockwise direction as viewed about the hinge 33 until it reaches the fully closed throttle position as shown in FIG. 2A. The movement of the first throttle plate 31 causes the second throttle plate 32 to be rotated in an anticlockwise direction as viewed about the hinge 34 due to the sliding interaction between the second throttle plate 32 and the rear face 31*r* of the first throttle plate 31. This has the effect of reducing the internal angle between the first and second throttle plates 31 and 32. It will be appreciated that in the case of this embodiment the second throttle plate 32 is shown as being longer than the first throttle plate 31 this is in order to ensure that in the fully closed position the internal angle never drops below a lower limiting angle below which opening motion of the first throttle plate 31 would either be blocked by the second throttle plate 32 acting as a strut or would cause the second throttle plate to rotate in the wrong direction.

Movement of the throttle valve 30 towards the wide open position is termed 'movement in a throttle opening direction' and movement of the throttle valve 30 towards the fully closed position is termed 'movement in a throttle closing direction'.

It will be appreciated that the throttle valve assembly 20 shown in FIGS. 2A-3 is diagrammatic in nature and is not intended to represent a fully engineered throttle valve assembly but merely provide an illustration of the principle of operation of a throttle valve assembly in accordance with this invention.

With particular reference to FIG. 1 operation of the engine air induction control system will now be described.

A demand for torque from the engine 10 is produced when an accelerator pedal such as the accelerator pedal 6 is depressed and the amount of torque demanded by the driver will depend upon the magnitude of depression of the accelerator pedal 6.

Although in some cases there is a linear relationship between the magnitude of accelerator pedal 6 depression and torque demand in other cases the relationship may not be linear. However, irrespective of the relationship, in general terms when a driver depresses the accelerator pedal 6 a demand for torque is produced that increases with increasing depression of the accelerator pedal 6 and this is sensed by the accelerator pedal position sensor 56 and is supplied as a torque demand input to the electronic controller 50.

The electronic controller 50 uses the input from the accelerator pedal position sensor 56 to control the position of the throttle valve 30 in the throttle body 21 by causing the actuator 40 to rotate the first throttle plate 31 in a desired direction.

For example, if the demand for torque from the driver increases from a current torque demand then the electronic controller 50 is operable to cause the actuator 40 to move the first and second throttle plates 31 and 32 of the throttle valve 30 in throttle opening direction so as to increase the flow rate of air to the engine 10. It will be appreciated that the amount of fuel supplied to the engine 10 will also be adjusted by the electronic controller 50 to produce a desired air fuel ratio.

Similarly, if the demand for torque from the driver reduces from the current demand then the electronic controller 50 is operable to cause the actuator 40 to move the first and second throttle plates 31 and 32 of the throttle valve 30 in a throttle closing direction to reduce the flow rate of air to the engine 10 and the amount of fuel supplied to the engine 10 will be adjusted by the electronic controller 50 to produce a desired air fuel ratio.

It will be appreciated that the electronic controller 50 may also be operable to vary the position of the throttle valve 30 and/or the amount of fuel supplied during constant engine running conditions in which the position of the accelerator pedal 6 is not adjusted by the driver in order to maintain a required air fuel ratio or to control emissions from the engine 10.

When the driver is not depressing the accelerator pedal 6 the controller 50 is operable to use the actuator 40 to move the throttle valve 30 to the closed throttle position shown in FIG. 2A and when the driver fully depresses the accelerator pedal 6 the electronic controller 50 is arranged to use the actuator to move the throttle valve 30 to the wide open throttle position shown in FIG. 3.

Figure 4A:
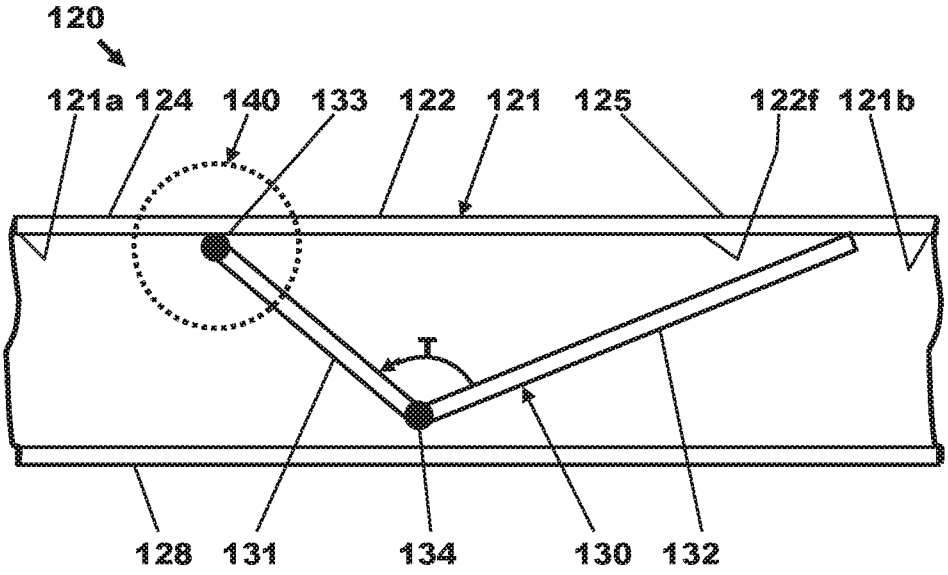
FIG. 4A is a diagrammatic cut-away side view of a throttle valve assembly constructed in accordance with said first aspect of the invention showing a second embodiment of a throttle valve in a throttle closed position.
Figure 4B:
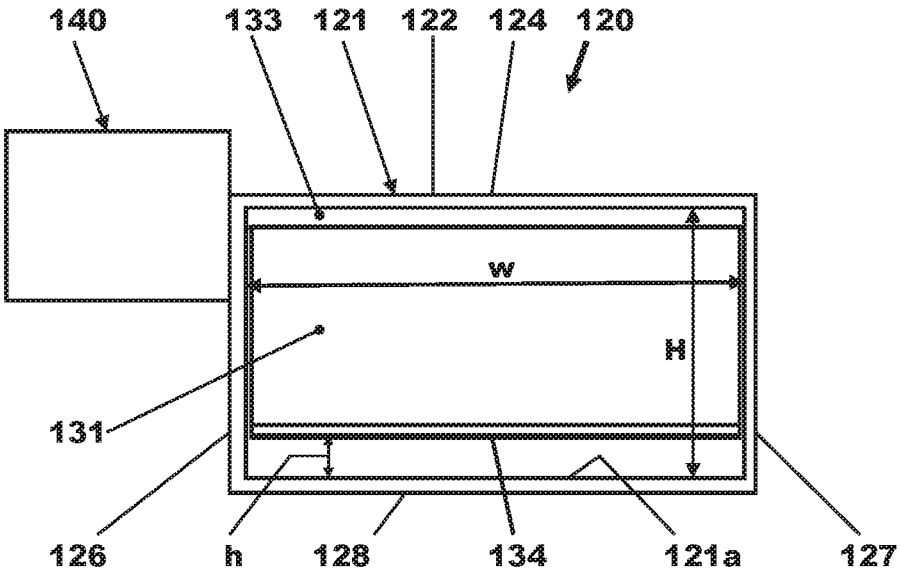
FIG. 4B is an inlet end view of the throttle valve assembly shown in FIG. 4A.
Figure 5:
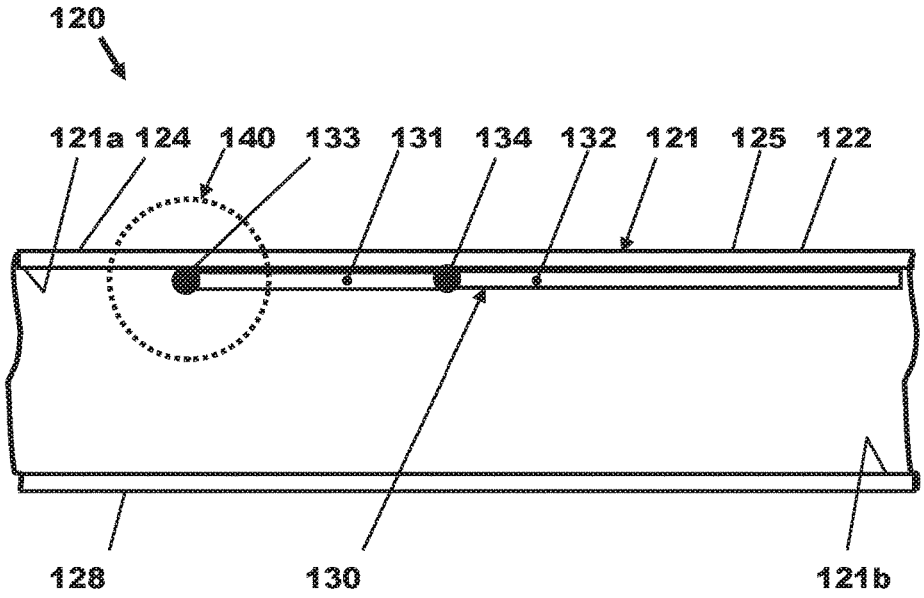
FIG. 5 is a diagrammatic cut-away side view similar to FIG. 4A but showing the throttle valve in a wide open throttle position.

With reference to FIGS. 4A-5 there is shown a second embodiment of a throttle valve assembly 120 that is intended to be a direct replacement for the throttle valve assembly 20 previously described.

The throttle valve assembly 120 comprises a throttle body 121 in which is mounted a throttle valve 130 the configuration of which is adjustable by the actuator 140. The actuator in this case comprises a motor 140 having an output shaft 133 attached to one end of a first or inlet throttle plate 131 of the throttle valve 130 so as to pivotally connect the first throttle plate 131 to the throttle body 121. The motor 140 along with the output shaft 133 form an electronically controllable actuator mechanism.

The throttle body 121 comprises an upper wall 122 having an inlet portion 124 upstream from the throttle valve 130 and an outlet portion 125 downstream from the throttle valve 130, a lower wall 128 and two side walls 126, 127 (shown on FIG. 4A).

A quadrilateral shaped inlet air flow passage is formed by the throttle body 121 having an inlet 121*a* formed by the inlet portion 124 of the upper wall 22, the lower wall 128 and the two side walls 126, 127. In the case of this example the air flow passage including the inlet 121*a* is rectangular in shape having a width 'w' that is greater than its height 'H'. It will be appreciated that in other embodiments the height could be greater than the width or the width and height could be substantially the same if the air flow passage is square in shape.

A quadrilateral shaped outlet 121*b* of the air flow passage is formed at an outlet end of the throttle body 121 by the outlet portion 125 of the upper wall 22, the lower wall 128 and the two side walls 126, 127. In the case of this example the outlet 121*b* is rectangular in shape having a width that is greater than its height. It will be appreciated that in other embodiments the width and height dimensions of the outlet 121*b* are substantially the same as the corresponding dimensions of the inlet 121*a*.

The throttle valve 130 comprises a pair of interacting throttle plates 131, 132 therebeing the first or upstream throttle plate 131 pivotally connected at an upper end to the throttle body 121 via the output shaft 133 of the motor 140 and a second or downstream throttle plate 132 hingedly connected at one end to the first throttle plate 131 by a hinge 134. A spring such as a torsion spring (not shown) is used to bias the second plate 132 in the direction of the arrow 'T' on FIG. 4A so as to maintain a sliding abutting contact of a free end of the second throttle plate 132 with an inner face 122*f* of the upper wall 122 of the throttle body 121. The second throttle plate 132 interacts with the first throttle plate 131 in the case of this second embodiment by the pivotal connection formed by the hinge 134 between the first and second throttle plates 131 and 132.

When the throttle valve 130 is moved between respective fully closed and wide open positions the second throttle plate 132 in the case of this second embodiment slides along the inner face 122*f* of the upper wall 122.

When the throttle valve 130 is in a flow restricting position the first throttle plate 131 forms with respect to the direction of air flow from the inlet 121*a* to the outlet 121*b* a converging flow passage and the second throttle plate 132 forms a diverging flow passage. The first and second throttle plates 131 and 132 are arranged in a "V" or convergent/divergent flow restricting configuration defining an internal angle therebetween in the case of this example of between substantially 180 and substantially 120 degrees. As before there is a minimum internal angle that can be used in order to ensure correct operation of the throttle valve 130 and the length of the first and second throttle plates 131 and 132 have to be chosen to ensure that in the fully closed throttle position this minimum internal angle is not breached.

In the case of this example the hinge 134 joining the first throttle plate 131 to the second throttle plate 132 is spaced a small distance from the lower wall 128 of the throttle body 121 when the throttle valve 130 is in the fully closed position shown in FIG. 4A but it will be appreciated that in other embodiments the hinge 134 could abut the lower wall 128 of the throttle body 121.

When the throttle valve 130 is in a wide open position, as shown in FIG. 5, the first and second throttle plates 131 and 132 lie end to end so as to be aligned with the upper wall 22 of the throttle body 121 thereby bridging between the inlet and outlet portions 124 and 125 of the upper wall 122 and forming a substantially flat continuous surface so as to produce the minimum resistance to air flow through the throttle body 121. In this position the internal angle between the first and second throttle plates 131 and 132 is substantially 180 degrees and they are said to be in a flat minimally intrusive configuration.

It will be appreciated that as the throttle valve 130 is transitioned from the wide open position shown in FIG. 5 to the fully closed position shown in FIG. 4A the flow area of the air flow passage in the throttle body 121 is reduced from a maximum air flow area substantially equal to (w×H) to a minimum air flow area equal to (w×h) where 'H' is the height of the air flow passage defined by the throttle body 121, 'w' is the width of the airflow passage defined by the throttle body 121 and 'h' is the distance from the hinge 134 to the inner face of the lower wall 128 of the throttle body 121.

Similarly, when the throttle valve 130 is transitioned from the fully closed position shown in FIG. 4A to the wide open position shown in FIG. 5 the flow area of the air flow passage in the throttle body 121 is increased from the minimum air flow area to the maximum air flow area.

Operation of the throttle valve assembly 120 is as follows. From the fully closed throttle position shown in FIG. 4A, to increase the air flow area of the throttle body 121 and hence the flow rate of air through the throttle body 121 the first throttle plate 131 of the throttle valve 130 is rotated by the motor 140 in a anticlockwise direction as viewed until it reaches the wide open throttle position shown in FIG. 5. The movement of the first throttle plate 131 causes the second throttle plate 132 to be rotated in a clockwise direction about the hinge 134 due to the pivotal connection between the first and second throttle plates 131 and 132 causing the second throttle plate 132 to slide along the inner face of the upper wall 22 thereby increasing the internal angle between the first and second throttle plates 131 and 132.

From the wide open throttle position shown in FIG. 5, to reduce the air flow area of the throttle body 121 and hence the flow rate of air through the throttle body 121 the first throttle plate 131 of the throttle valve 130 is rotated by the motor 140 in a clockwise direction as viewed until it reaches the fully closed throttle position as shown in FIG. 4A. The movement of the first throttle plate 131 causes the second throttle plate 132 to be rotated in an anticlockwise direction as viewed about the hinge 134 due to the interaction between the second throttle plate 132 and the first throttle plate 131 via the hinge 134 thereby reducing the internal angle between the first and second throttle plates 131 and 132.

Movement of the throttle valve 130 towards the wide open position is termed 'movement in a throttle opening direction' and movement of the throttle valve 130 towards the fully closed position is termed 'movement in a throttle closing direction'.

It will be appreciated that the throttle valve assembly 120 shown in FIGS. 4A-5 is diagrammatic in nature and is not intended to represent a fully engineered throttle valve assembly but merely provide an illustration of the principle of operation of a throttle valve assembly in accordance with this invention.

It will be appreciated that the throttle valve assembly 120 could be used as a direct replacement for the throttle valve assembly 20 in the engine air induction control system shown in FIG. 1. The only significant difference between the first embodiment and this embodiment is that instead of the first throttle plate being rotated by a ram it is in the case of this second embodiment rotated by the motor 140.

As before, when a driver is not depressing the accelerator pedal 6 the controller 50 would be operable to use the motor 140 to move the throttle valve 130 to the closed throttle position shown in FIG. 4A and when the driver fully depresses the accelerator pedal 6 the electronic controller 50 would be arranged to use the motor 140 to move the throttle valve 130 to the wide open throttle position shown in FIG. 5.

It will be appreciated that the throttle valves 30; 130 are moveable to numerous intermediate positions between the closed and wide open positions by their respective actuators 40; 140 and that this movement may be performed in a stepless continuously variable manner.

Although the invention has been described with reference to two embodiments, one using a rotary electric actuator and one using an electromagnetic linear actuator it will be appreciated that other types of actuator could be used. For example, the actuator could be an electronically controllable hydraulic actuator or an electronically controllable pneumatic actuator.

It will be appreciated that the invention is not limited to use on a direct injection gasoline engine and could be used on any engine requiring an electronically controllable throttle valve.

One of the advantages of the invention is that the two throttle plates of the throttle valve are stowed adjacent a wall of the throttle body in the wide open throttle position rather than mid-stream as is the case with a butterfly type valve. It will be appreciated that less turbulence and reduction in flow will be produced by stowing the throttle plates at the side of the air flow passage because the flow velocity of an air flow at the edge of the air flow through a duct or passage is considerably less than it is mid-stream.

Therefore in summary, the invention provides a throttle valve assembly that reduces the turbulence and pressure drop across the throttle valve compared with a butterfly type throttle valve by using two throttle plates to produce the following advantages: improved fuel economy, improved maximum torque, improved power, and improved exhaust emissions, including CO2.

It will be appreciated by those skilled in the art that although the invention has been described by way of example with reference to one or more embodiments it is not limited to the disclosed embodiments and that alternative embodiments could be constructed without departing from the scope of the invention as defined by the appended claims.

The invention claimed is:

1. A throttle valve assembly comprising a throttle body defining a quadrilateral shaped air flow passage and a throttle valve mounted in an air flow passage of the throttle body, the throttle valve comprising first and second interacting throttle plates configurable to produce a convergent/divergent flow restricting configuration when a reduced flow of air through the throttle body is required and into a flat minimally intrusive flow restricting configuration when no reduction in the flow of air through the throttle body is required, wherein the first throttle plate is positioned upstream from the second throttle plate and forms a convergent part of the convergent/divergent flow restricting configuration and the second throttle plate forms a divergent part of the convergent/divergent flow restricting configuration.

2. The assembly as claimed in claim 1, wherein the assembly further comprises an actuator and the first and second throttle plates are configurable by the actuator to produce the convergent/divergent flow restricting configuration when a reduced flow of air through the throttle body is required and into the flat minimally intrusive flow restricting configuration when no reduction in the flow of air through the throttle body is required.

3. The assembly as claimed in claim 2, wherein the first throttle plate is rotatable about one end by the actuator and the second throttle plate is rotatable by an interaction of the second throttle plate with the first throttle plate.

4. The assembly as claimed in claim 1, wherein the quadrilateral air flow passage is defined by an upper wall of the throttle body, a lower wall of the throttle body and two side walls of the throttle body and the first throttle plate is pivotally connected to the upper wall of the throttle body.

5. The assembly as claimed in claim 4, wherein the second throttle plate is rotatably connected to the upper wall of the throttle body and interacts with the first throttle plate via a sliding interaction of a free end of the second throttle plate with a rear face of the first throttle plate.

6. The assembly as claimed in claim 5, wherein in the flat minimally intrusive flow restricting configuration the first and second throttle plates lie upon one another against an inner surface of the upper wall of the throttle body.

7. The assembly as claimed in claim 4, wherein the second throttle plate interacts with the first throttle plate via a pivotal connection and has a free end slidingly abutting an inner surface of the upper wall of the throttle body.

8. The assembly as claimed in claim 7, wherein in the flat minimally intrusive flow restricting configuration the first and second throttle plates lie end to end against the inner surface of the upper wall of the throttle body.

9. An engine air induction control system for a motor vehicle comprising an air flow path to an engine including a throttle valve assembly comprising a throttle body defining a quadrilateral shaped air flow passage and a throttle valve mounted in an air flow passage of the throttle body, the throttle valve comprising first and second interacting throttle plates configurable to produce a convergent/divergent flow restricting configuration when a reduced flow of air through the throttle body is required and into a flat minimally intrusive flow restricting configuration when no reduction in the flow of air through the throttle body is required, wherein the first throttle plate is positioned upstream from the second throttle plate and forms a convergent part of the convergent/divergent flow restricting configuration and the second throttle plate forms a divergent part of the convergent/divergent flow restricting configuration; an electronic controller, an accelerator pedal position sensor associated with an accelerator pedal of the motor vehicle to provide a driver torque demand input to the electronic controller and an electronically controllable actuator forming part of the throttle valve assembly operably connected to the electronic controller.

10. The system as claimed in claim 9, wherein the electronic controller is arranged to operate the electronically controllable actuator to move the throttle valve based upon the driver demand input from the accelerator pedal position sensor.

11. The system as claimed in claim 10, wherein the electronic controller is operable to use the electronically controllable actuator to move the throttle valve of the throttle valve assembly to increase the air flow area of the throttle body from the current air flow area if the input from the accelerator pedal position sensor indicates a request for increased engine torque.

12. The system as claimed in claim 10, wherein the electronic controller is operable to use the electronically controllable actuator to move the throttle valve of the throttle valve assembly to reduce the air flow area of the throttle body from the current air flow area if the input from the accelerator pedal position sensor indicates a request for reduced engine torque.

13. A motor vehicle having an internal combustion engine and an engine air induction control system comprising an air flow path to the engine including a throttle valve assembly comprising a throttle body defining a quadrilateral shaped air flow passage and a throttle valve mounted in an air flow passage of the throttle body, the throttle valve comprising first and second interacting throttle plates configurable to produce a convergent/divergent flow restricting configuration when a reduced flow of air through the throttle body is required and into a flat minimally intrusive flow restricting configuration when no reduction in the flow of air through the throttle body is required, wherein the first throttle plate is positioned upstream from the second throttle plate and forms a convergent part of the convergent/divergent flow restricting configuration and the second throttle plate forms a divergent part of the convergent/divergent flow restricting configuration; an electronic controller, an accelerator pedal position sensor associated with an accelerator pedal of the motor vehicle to provide a driver torque demand input to the electronic controller and an electronically controllable actuator forming part of the throttle valve assembly operably connected to the electronic controller.

14. The assembly as claimed in claim 2, wherein the quadrilateral air flow passage is defined by an upper wall of the throttle body, a lower wall of the throttle body and two side walls of the throttle body and the first throttle plate is pivotally connected to the upper wall of the throttle body.

15. The assembly as claimed in claim 3, wherein the quadrilateral air flow passage is defined by an upper wall of the throttle body, a lower wall of the throttle body and two side walls of the throttle body and the first throttle plate is pivotally connected to the upper wall of the throttle body.

16. The system as claimed in claim 9, wherein the first and second throttle plates are configurable by the actuator to produce the convergent/divergent flow restricting configuration when a reduced flow of air through the throttle body is required and into the flat minimally intrusive flow restricting configuration when no reduction in the flow of air through the throttle body is required.

17. The system as claimed in claim 16, wherein the first throttle plate is rotatable about one end by the actuator and the second throttle plate is rotatable by an interaction of the second throttle plate with the first throttle plate.

18. The system as claimed in claim 9, wherein the quadrilateral air flow passage is defined by an upper wall of the throttle body, a lower wall of the throttle body and two side walls of the throttle body and the first throttle plate is pivotally connected to the upper wall of the throttle body.

19. The system as claimed in claim 18, wherein the second throttle plate interacts with the first throttle plate via a pivotal connection and has a free end slidingly abutting an inner surface of the upper wall of the throttle body.

* * * * *